US005855030A

United States Patent [19]

Williams

[11] Patent Number: 5,855,030

[45] Date of Patent: Jan. 5, 1999

[54] FOLDING SOFA BED FRAME STRUCTURE WITH TWO-POSITION TV HEADREST

[75] Inventor: Allen M. Williams, Van Buren, Ark.

[73] Assignee: Hickory Springs Manufacturing Co., Hickory, N.C.

[21] Appl. No.: 712,420

[22] Filed: Sep. 11, 1996

[51] Int. Cl.[6] ..... A47C 17/14

[52] U.S. Cl. ..... 5/13; 5/12.1; 5/14; 5/53.2; 5/617

[58] Field of Search ..... 5/13, 12.1, 14, 5/53.2, 617, 613; 297/16.1

[56] References Cited

U.S. PATENT DOCUMENTS

| | | | |
|---|---|---|---|
| 219,264 | 9/1879 | Howe | 5/617 |
| 323,572 | 8/1885 | Fieldy | 5/617 |
| 463,944 | 11/1891 | Coughlin | 5/617 |
| 845,039 | 2/1907 | Leavitt | 5/617 |
| 3,984,883 | 10/1976 | Wong | 5/13 |
| 4,035,852 | 7/1977 | Cycowicz et al. | 5/13 |
| 4,104,745 | 8/1978 | Pacitti . | |
| 4,200,941 | 5/1980 | Gill et al. | 5/13 |
| 4,447,921 | 5/1984 | Greenblatt | 5/13 |
| 4,571,756 | 2/1986 | Castro et al. . | |
| 4,669,134 | 6/1987 | Mikos . | |
| 5,138,727 | 8/1992 | Hanes et al. . | |
| 5,257,424 | 11/1993 | Rogers . | |
| 5,450,637 | 9/1995 | Hanes et al. . | |

*Primary Examiner*—Brian K. Green
*Assistant Examiner*—Frederick Conley
*Attorney, Agent, or Firm*—Kennedy Covington Lobdell & Hickman

[57] ABSTRACT

A folding sofa bed frame structure has a TV control link and an associated toothed ratchet element connected thereto, by which the rear end section of the structure can be selectively positioned in two differing "TV" positions. A cam portion on the ratchet element automatically effects disengagement from either TV position upon pivoting of the rear end section into a substantially perpendicular relation to the main intermediate section of the structure. The ratchet arrangement is effective to automatically engage into and disengage from either TV position without manual manipulation, other than manual lifting of the rear end section, and is automatically effective to disengage when the bed frame structure is folded into the sofa frame.

7 Claims, 10 Drawing Sheets

FOLDING SOFA BED FRAME STRUCTURE WITH TWO-POSITION TV HEADREST

BACKGROUND OF THE INVENTION

The present invention relates generally to folding bed frame structures and, more particularly, to folding bed frames of the type specially adapted for opening and folding articulation from and into the enclosure of a sofa frame or the like.

Convertible sofa beds having widely varying folding bed frame structures are in common use. Characteristically, the folding bed frames of such sofa beds are provided with a plurality of bed sections pivotally connected in end-to-end relation and operatively associated with a linkage arrangement for mounting within the rectangular enclosure of a sofa bed frame defined by its side frame members, which normally comprise the sofa armrests, its sofa back and a front rail, to be articulable between a folded or retracted condition stored within the sofa frame enclosure and a horizontally extended condition disposed and extending outwardly from the enclosure over and beyond the front rail of the sofa frame.

Over the years, substantial activity has been devoted to the improvement of folding bed frame structures of this type. One improved feature which as proved to be popular and useful is the provision of the rear end or "head" section of a folding sofa bed frame structure with the ability to be raised into an inclined position independently of the other bed sections after the structure has been unfolded into its extended position. Such an inclined disposition of the head section is intended to raise the head and shoulders of the user into a convenient position suitable for viewing television, reading, etc., while reclined on the sofa bed. Hence, this feature has come to be commonly referred to in sofa bed frame structures as a "TV position." Representative examples of known constructions of sofa bed frames with the capability of such a TV position are U.S. Pat. Nos. 3,984,883; 4,035,852; 4,104,745; 4,200,941; 4,571,756; 4,669,134; and 5,257,424.

In the past, the mechanisms used to achieve such TV positioning have often been complicated and inconvenient to use, as well as sometimes proving to be unreliable in long-term operation. Most commercially available sofa bed frames with a TV position head rest are capable of establishing only a single TV position, which is not necessarily comfortable for all users. Also, such sofa beds typically require that the latching mechanism be disengaged manually to return the head section to a horizontal sleeping position before the structure can be folded back into the sofa frame for storage. Some efforts have been made to address these disadvantages. For example, U.S. Pat. No. 4,669,134 discloses a sofa frame structure whose head section is selectively positionable in two differently inclined TV positions. U.S. Pat. No. 4,571,756 discloses a sofa bed frame with an auxiliary TV position linkage associated with the head section of the structure, which is adapted to automatically disengage upon folding of the bed frame into its stored position.

SUMMARY OF THE INVENTION

It is accordingly a basic object of the present invention to provide a folding sofa bed frame structure with an improved mechanism for TV positioning of the head section of the structure which overcomes the aforedescribed disadvantages. More particularly, it is an object of the present invention to provide a TV mechanism in the present sofa bed frame structure which enables selection between two differently inclined TV positions to suit the comfort and preferences of differing users. Another object is that the TV positioning mechanism be adapted to automatically disengage in response to the folding of the structure into a stored position within an associated sofa frame. The present invention also seeks to achieve these objectives by means of a mechanism which is of simple construction, easy to manufacture, and reliable in repeated operation over an extended life of the sofa bed frame.

The folding bed frame structure of the present invention is intended to be adapted to a wide variety of sofa bed frame structures of the basic type comprising a plurality of bed sections pivotally interconnected in end-to-end relation and controlled by an associated linkage arrangement adapted to be affixed to a sofa frame to support the bed sections and control their movement in a predetermined pattern between a rearward retracted position in which the bed sections are folded relative to one another within the frame and a forward extended position in which the bed sections are horizontally aligned for sleeping. Characteristically, such a folding bed frame structure includes a rear end section for support of a user's head and an intermediate section pivoted to the rear end section for primary support of a user's body when in the forward extended position. The linkage arrangement includes a TV control link which extends between the rear end section and the intermediate section at the pivotal connection therebetween to follow relative pivoting movements thereof.

In accordance with the present invention, the above-stated objectives are achieved by providing a ratchet element connected with the TV control link to move therewith. The ratchet element is formed with first and second locking notches and with an unlocking cam portion. When the rear end section and the intermediate section are horizontally aligned, the ratchet element is in an inactive position. However, when the rear end section is pivoted into an angular relationship with the intermediate section, the ratchet element moves with the TV control link into a first locking position wherein the first notch is in engagement with the intermediate section to fix the rear end section and the intermediate section in a first TV position. Further pivoting movement of the rear end section relative to the intermediate section causes the ratchet element to move with the TV control link into a second locking position wherein the second notch engages the intermediate section to fix the rear end section and the intermediate section in a second TV position. When the rear end section is pivoted still further with respect to the intermediate section, the TV control link moves the ratchet element into a release position wherein the cam portion is positioned for engagement with the intermediate section for deflecting the first and second notches away from the intermediate section, thus permitting relative pivoting movement of the rear end section back into horizontal alignment with the intermediate section. Preferably, such release position is automatically achieved during any folding movement of the bed frame structure into its rearward retracted position within the sofa frame so that, upon the next unfolding of the structure into its extended position, the rear end section initially assumes a horizontal alignment with the intermediate section.

In the preferred embodiment of the present invention, the TV control link is pivotably connected at its opposite ends respectively to the rear end section and to the intermediate section, with one end of the TV control link comprising a slidable connection with the respective bed section to permit relative pivoting movements of the rear end bed section, the intermediate bed section and the TV control link. The ratchet element, in turn, is pivotably affixed to the TV control link, preferably at an intermediate location therealong. Both the rear end section and the intermediate section of the folding bed structure comprise respective side rails which align with one another in the extended position, the side rail of the rear end section being formed with a recessed area at its end adjacent the intermediate section to receive the ratchet element in such recessed area in appropriate disposition to engage the side rail of the intermediate section with the first and second notches and with the cam portion as the ratchet element moves between the two TV positions and the release position. In the first TV position, the ratchet element secures the rear end section at an inclination to the intermediate section of an approximately twenty-nine degree (29°) angle. In the second TV position, the angle of inclination is increased to approximately forty-two degrees (42°). To achieve the release position, the rear end section is pivoted beyond the second TV position generally into a perpendicular relationship to the intermediate section, which is approximately one hundred degrees (100°) in the preferred embodiment.

DETAILED DESCRIPTION OF THE PREFERRED EMBODIMENT

Figure 1:
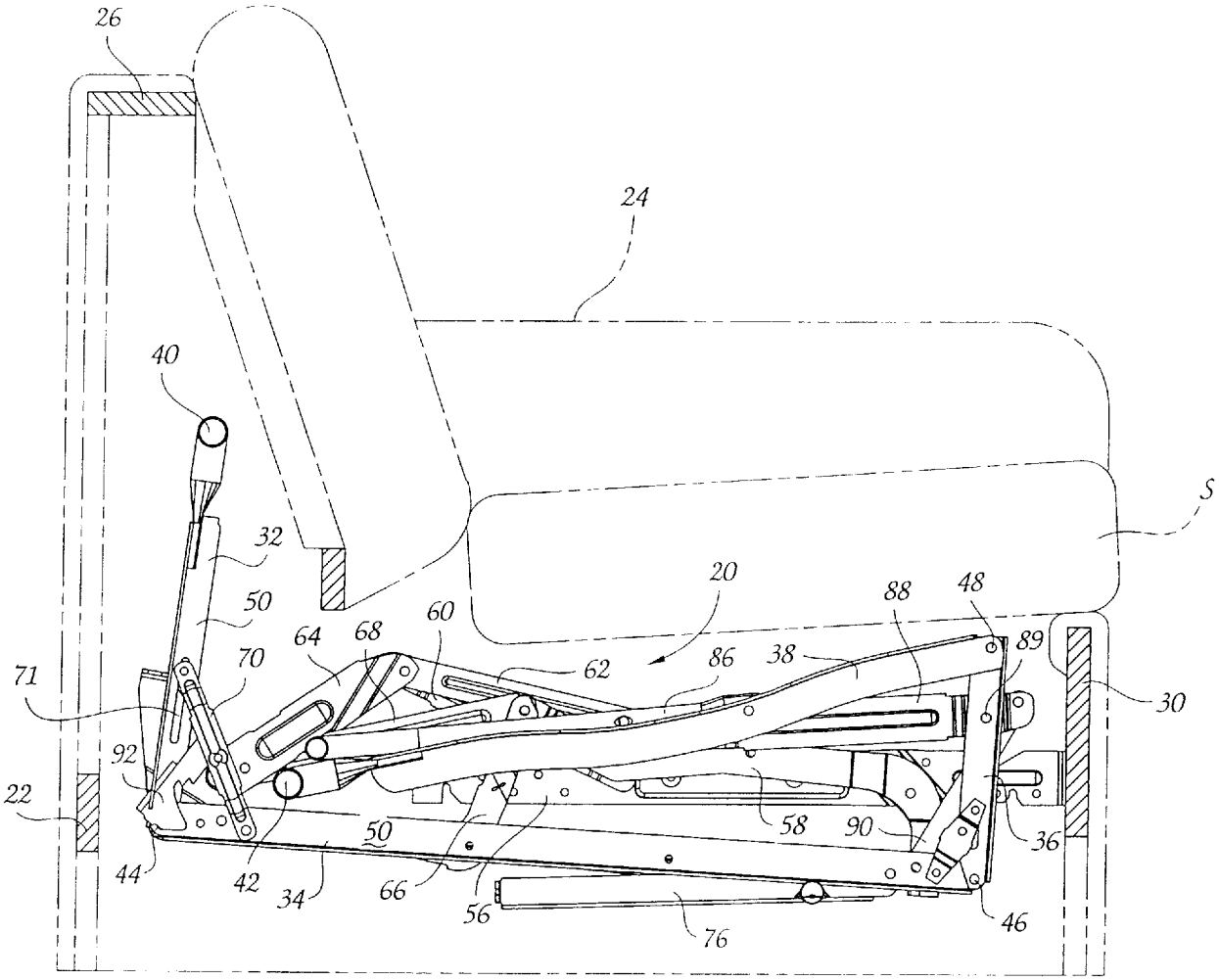
FIGS. 1, 2 and 3 are side elevational views of an end portion of a sofa bed in which is mounted the preferred embodiment of the folding bed frame structure of the present invention, illustrating the bed frame structure in successive positions in its movement from its retracted position in FIG. 1 to its fully extended position in FIG. 3, the sofa frame being shown only schematically in phantom lines for clarity of illustration of the bed frame structure.
Figure 2:
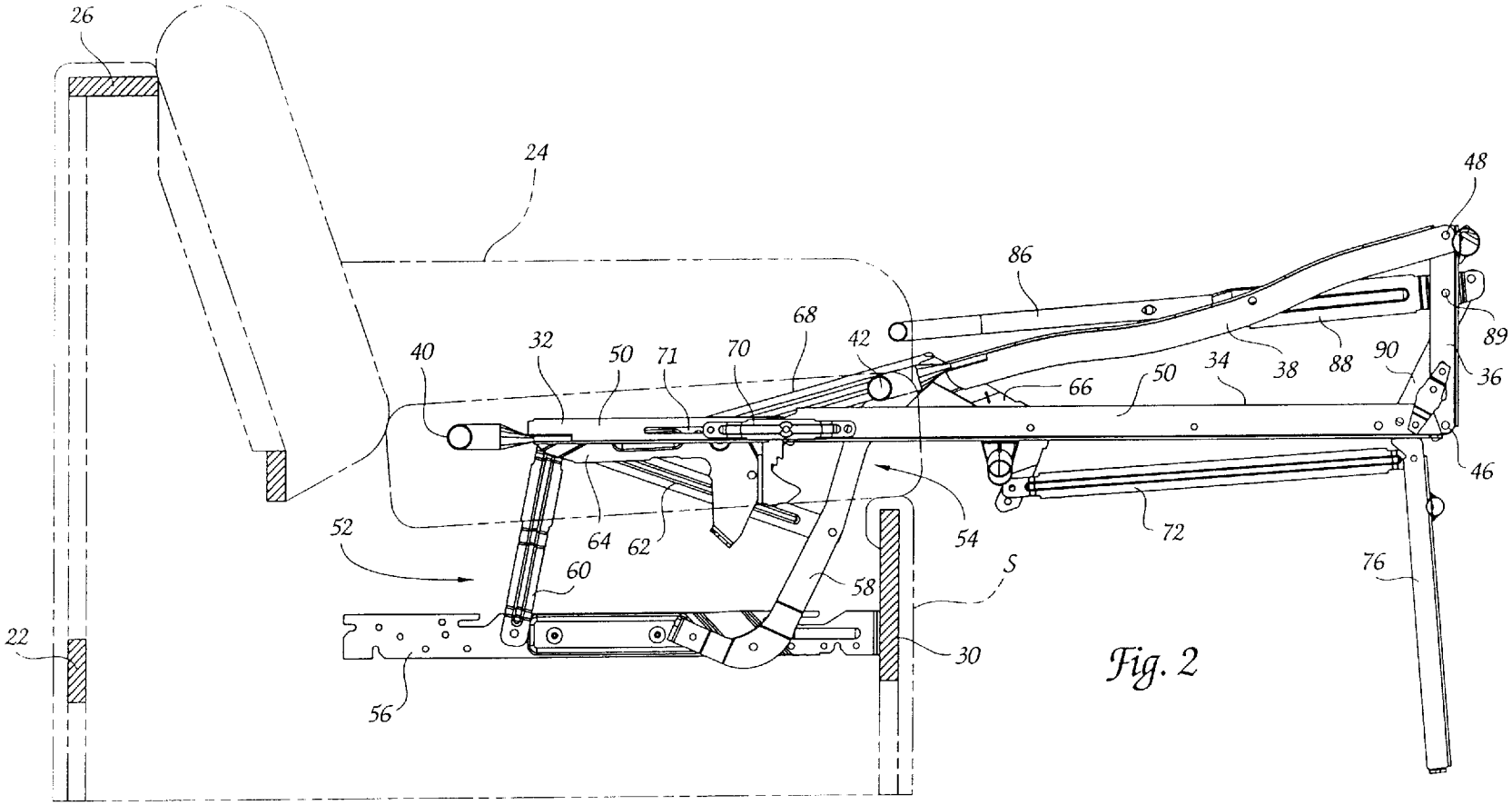
Figure 3:
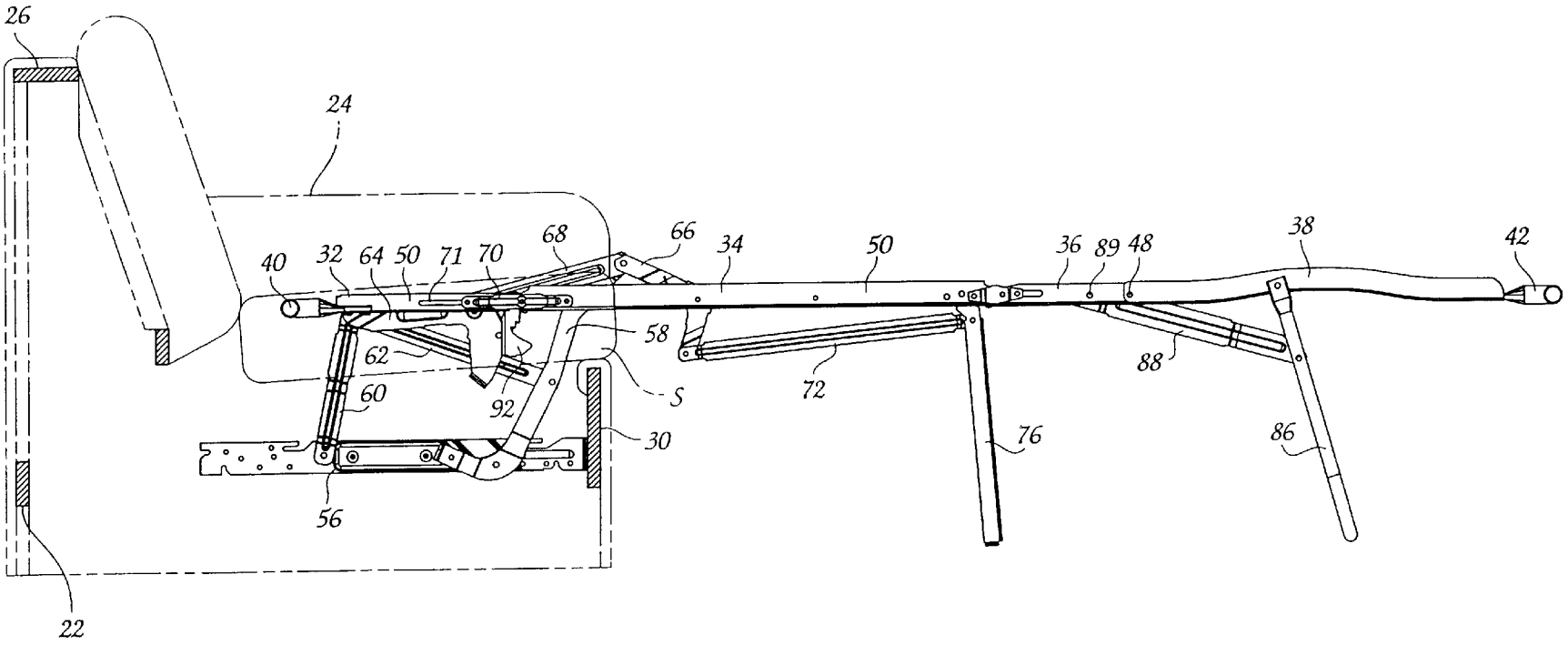

Referring now to the accompanying drawings and initially to FIGS. 1–3, the folding bed frame structure of the present invention is generally indicated at 20 and is illustrated in its preferred embodiment in a sofa frame 22 of conventional construction. The sofa frame 22 forms no part of the present invention and therefore is illustrated only schematically and in phantom lines in the accompanying drawings to enhance the clarity of illustration of the folding bed frame structure 20. As is conventional, the sofa frame 22 basically comprises a pair of upstanding side frame members 24 spaced in parallel relation to form the sofa armrests, an upright hollow seat back 26 extending horizontally between corresponding sides of the side frame members 24, and a front rail 30 extending horizontally between the other corresponding sides of the side frame members 24 in parallel relation to the seat back 26.

The folding bed frame structure basically includes four bed sections 32,34,36,38 pivotally connected in end-to-end relation and a linkage arrangement adapted for affixation interiorly to the sofa frame 22 and operably associated with the bed sections 32,34,36,38 for supporting them on the sofa frame 22 and articulably actuating and controlling pivotal movement of the bed sections 32,34,36,38 in a predetermined pattern between a rearwardly retracted position in which the bed sections 32,34,36,38 are folded relative to one another within the enclosure of the sofa frame 22 (FIG. 1) and a forwardly extended position in which the bed sections 32,34,36,38 are horizontally aligned (FIG. 3). As used herein, the terms "forward," "rearward" and "intermediate" and variations thereof define positions of the folding bed frame structure 20 relative to the sofa frame 22 and the manner in which the bed frame structure 20 is adapted to be relatively disposed therewithin, "forward" being the direction from the seat back 26 toward the front rail 30 generally parallel with the extent of the side frame members 24 and "rearward" being the opposite direction.

As will be understood, the folding bed frame structure 20 extends between the side frame members 24 substantially the width of the sofa frame 22 and includes identical bed section and linkage components at each side, the corresponding components at the opposite sides of the folding bed frame structure 20 being operably associated for simultaneous identical movement in a conventional manner by the rearward and forward bed sections 32,38, which respectively include integral end portions 40,42 extending transversely between the opposite sides of the bed frame structure 20. In addition, spaced cross members (not shown) may also extend transversely between the bed sections. As the components of the folding bed frame structure 20 are identical at each side, only the components at one side thereof are herein illustrated and described. It will also be understood that a bed spring and fabric covering therefor extend across the bed sections 32,34,36,38 in known fashion to provide a supporting surface for a mattress, the mattress and bed spring arrangement providing in a conventional manner a horizontal surface for support thereon of the seat cushions of the sofa in the aforementioned folded position of the bed frame structure 20 within the sofa frame 22. Neither the bed spring and covering arrangement nor the mattress form any part of the present invention and, accordingly, they are not shown in the drawings in the interest of clarity of illustration.

Looking now in greater detail to the bed frame structure 20 in FIGS. 1–3, the bed sections 32,34,36,38 include a rear end or head support section 32 the end 40 of which is free and unsupported and the other end of which is pivotably connected at 44 to an end of a first intermediate section 34 which forms the main weight-bearing support section of the bed sections. The main intermediate section 34 is pivotably connected at its other end to an end of a second intermediate section 36 at 46, which is pivotably connected at its other end at 48 to an end of a forward end or foot support section 38. As is conventional, each bed section 32,34,36,38 is formed of opposed side rails 50 connected as noted above by cross-members, the free ends of the side rails 50 of the head support section 32 being integral with its transverse end portion 40 and the free ends of the side rails of the foot support section 38 being similarly integral with its transverse end portion 42. Preferably, the side rails 50 of each bed section are made of conventional L-shaped angle rod stock and the end portions 40,42 of bed sections 32,38 are made of conventional round tubing.

The linkage arrangement of the bed frame structure 20 basically comprises a support linkage arrangement, indicated generally at 52 in FIGS. 2 and 3, for supporting the bed sections 32,34,36,38 on the sofa frame through their movement between their folded and extended positions and an actuating and control linkage arrangement, indicated generally at 54 in FIGS. 2 and 3, associated with the support linkage 52 for transmitting folding and unfolding movement to the bed sections 32,34,36,38. As will be hereinafter explained in greater detail, the support linkage 52 and the actuating and control linkage 54 are cooperatively arranged to cause the bed sections 32,34,36,38 to fold relative to one another within the sofa frame 22 with the rear end section 32 in an upstanding disposition extending upwardly within the hollow sofa back 26 and with the main intermediate and forward end sections 34,36 disposed forwardly of the rear end section 32 in superposed, substantially parallel relation spaced apart by the second intermediate section 36 which assumes a vertical disposition forwardly of the main intermediate and forward sections 34,38, and to cause the bed sections 32,34,36,38 to articulably unfold from such folded disposition forwardly and upwardly from the sofa frame enclosure over the front rail 30 to the horizontally aligned extended position.

The support linkage 52 includes a horizontal support bracket 56 adapted for affixation interiorly to the side frame members 24 of the sofa frame 22, with two primary support links 58,60, being pivotably fixed at a horizontal spacing to the support bracket 56. As can be seen from the drawings, the forward support link 58 is substantially longer than the rear support link 60. A control link 62 extends between the two support links 58,60, the control link 62 being pivotably affixed at one end thereof to the outward free end of the rear support link 60 and being pivotably affixed at the other end thereof intermediately to the front support link 58. One end of a secondary support link 64 is also pivotably affixed with the rear support link 60 and the control link 62 at the outward free end of the rear support link 60 and extends therefrom and is pivotably connected to the main intermediate bed section 34 at its pivot 44 with the rear end bed section 32, thereby to provide support for such bed sections 32,34. Another secondary support link 66 in the form of a bell crank is pivoted at an intermediate point thereon to the side rail 50 forming the main intermediate section 34 intermediate the pivots 44,46 at the ends of the main intermediate section 34, with the end of one arm of the secondary support link 66 being pivotably affixed to the outward free end of the front support link 58, thereby providing additional support for the main intermediate bed section 34.

The actuating and control linkage 54 extends in association with the four bed sections 32,34,36,38 substantially the length thereof. A rear end section control link 68 is pivotably affixed at one end thereof to the secondary support link 64 intermediate its ends and extends to the outward free end of the front support link 58 at which the control link 68 is pivoted commonly with the front support link 58 and the secondary support link 66. A slide link 70 is pivoted at one end thereof to the side rail 50 forming the main intermediate section 34 at a slight spacing forwardly from the pivot point 44 between the rear and intermediate bed sections 32,34, and the slide link 70 extends therefrom rearwardly to the side rail 50 of the rear end section 32 wherein the opposite end of the slide link 70 is pivoted within an elongate slot 71 extending within the side rail 50 of the rear end section 32. As more fully explained below, the slide link 70 is thusly arranged to transmit folding and unfolding movements to the rear end section 32, while the slotted connection between the slide link 70 and the rear end section 32 also permits independent pivoting of the rear end section 32 relative to the intermediate section 34.

As will be understood, the main intermediate section 34 is horizontally disposed in both the folded and extended positions and moves between the positions in a substantially translatory manner. A support leg 76 is pivoted to the main intermediate section at its forward end adjacent the pivot 46 to provide additional support for the main intermediate section 34 in the extended position. An actuating link 72 extends between and is pivotably connected at its opposite ends to the other arm of the bell-crank secondary support link 66 and to the support leg 76 adjacent its pivoted end, the actuating link 72 being thereby arranged to actuate pivoting of the support leg 76 between a folded disposition alongside the main intermediate section 34 and a vertical disposition depending from the main intermediate section 34 upon the movement of the bed sections 32,34,36,38 between their folded and extended positions, respectively.

A forward support leg 86 is pivotably connected to the forward end section 38 intermediately along its length to provide support therefor in the extended position. An actuating lever 88 is fulcrumed at 89 adjacent one end thereof to the second intermediate section 36 intermediately along its length, with the opposite distal end of the lever 88 being pivotably connected to the support leg 86. One end of an actuating link 90 is pivotably connected to the end of the lever 88 adjacent its fulcrum 89 and the opposite end of the actuating link 90 is pivotably connected to the main intermediate section commonly with the pivoted end of the support leg 76 adjacent the pivot 46. In this manner, the actuating lever 88 and the actuating link 90 cooperatively actuate movement of the forward leg 86 between a folded disposition alongside the forward end section 38 in the folded position of the bed structure 20 and a vertical supporting disposition depending from the forward end section 38 in the extended position of the bed structure 20.

The basic folding and unfolding operation of the bed frame structure 20 is as follows. Initially, the seat cushions S of the sofa are removed. With the bed frame structure 20 in the folded condition of FIG. 1, the underside of the bed spring and fabric cover arrangement extending between the side rails of the forward end section 38 faces upwardly. According to conventional practice, a handle member (not shown) is provided adjacent the front rail, either formed in the bed spring and cover arrangement or formed on a cross member between the side rails of the forward end section 38, whereby the structure 20 may be manually lifted from its stored position. The exertion of a lifting force to the structure through the handle member operates to swingably pivot the support links 58,60 in generally parallel relation under the constraint of the control link 62 into an essentially upstanding disposition of the support links 58,60, as shown in FIG. 2. During such motion, the secondary support link 64, the control link 68 and the slide link 70 cooperate to pivot the rear end section 32 downwardly into substantial alignment with the main intermediate section 34. At the same time, the bell-crank secondary support link 66 is operated by the forward support link 58 to transmit unfolding movement of the support leg 76 through the actuating link 72.

As can be seen from FIGS. 1 and 2, the relative positions of the main intermediate, second intermediate and forward end sections 34,36,38 remain unchanged through the above-described movement. In the position of FIG. 2, the bed frame structure 20 is supported in a stable disposition with its rear end and main intermediate sections 32,34 supported in horizontal disposition in alignment with one another by the support links 58,60,64,66 and by the support leg 76. The second intermediate and forward end sections 36,38 are moved into horizontal alignment with the rear end and main intermediate sections 32,34 by manually pulling forward on the forward support leg 86 and then pulling forward on the end portion 42 to cause the second intermediate section 36 to pivot about its pivot 46 with the main intermediate section 34 and to cause the forward end section 38 to pivot about its pivot 48 with the second intermediate section 36, as shown in FIG. 3. As the second intermediate and forward end sections 36,38 are unfolded in this manner, the actuating lever 88 and the actuating link 90 cause the forward support leg 86 to pivot outwardly from alongside the forward end section 38 into a vertical supporting disposition depending therefrom.

Figure 6:
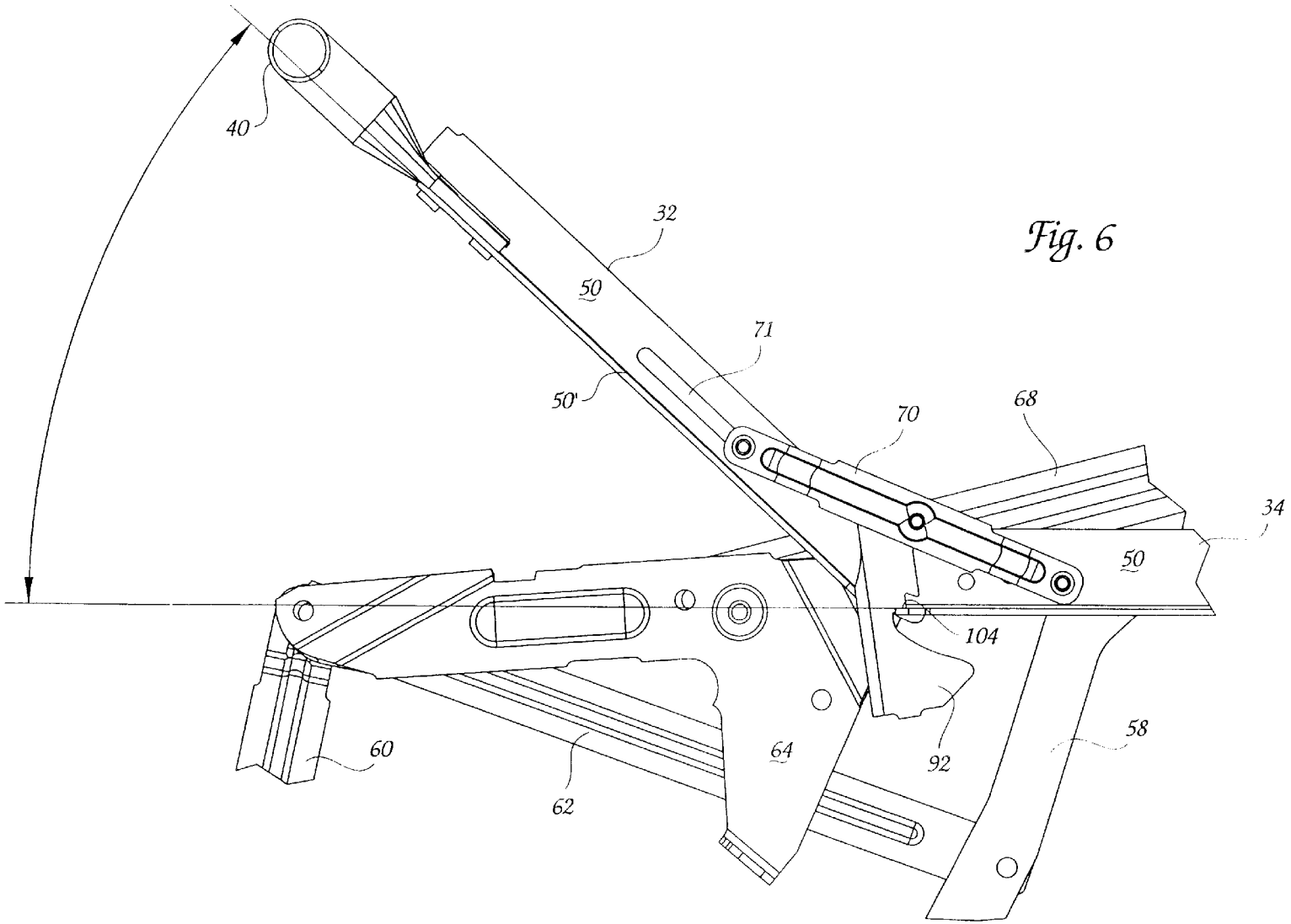
Figure 7:
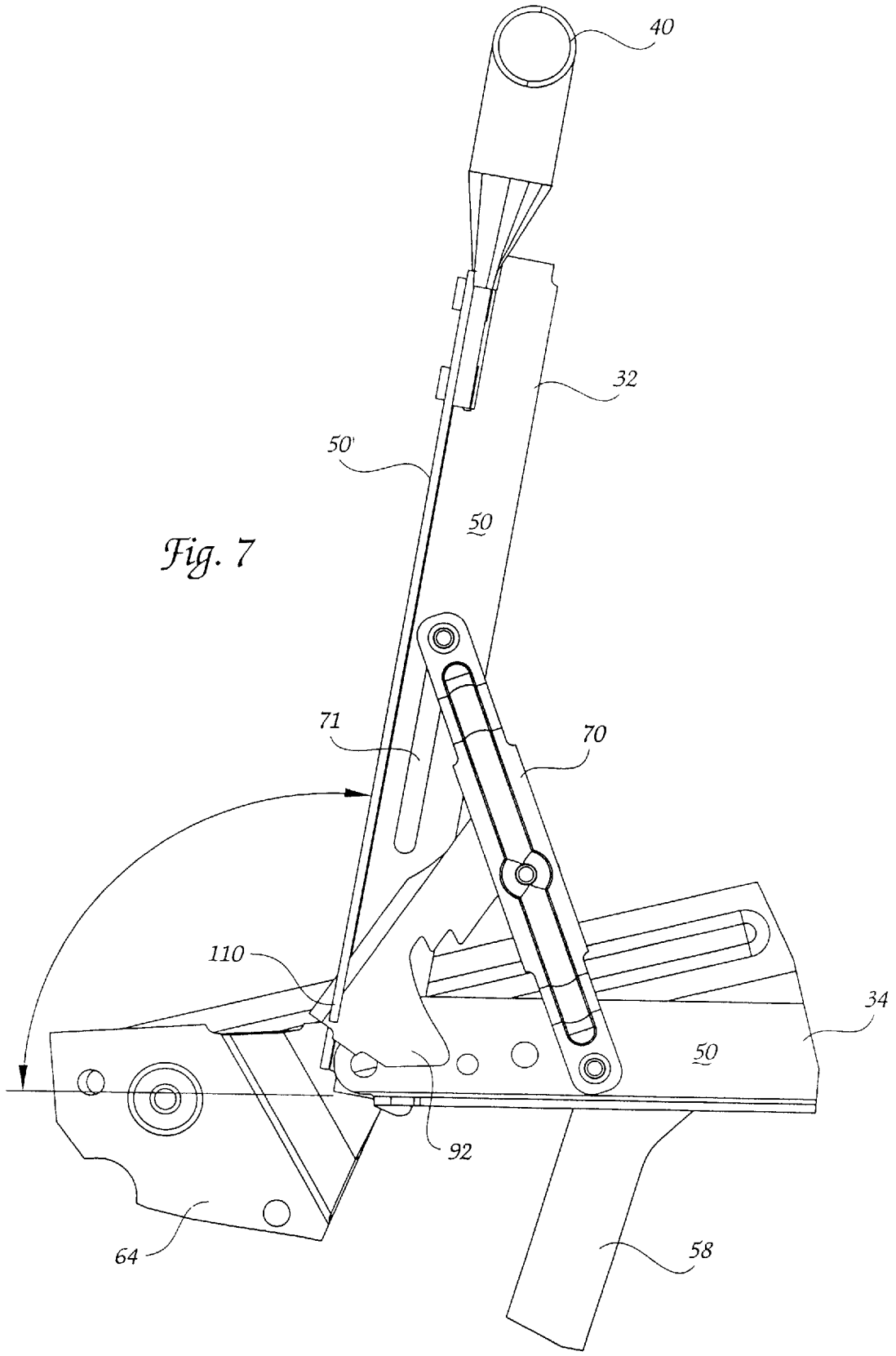
Figure 8B:
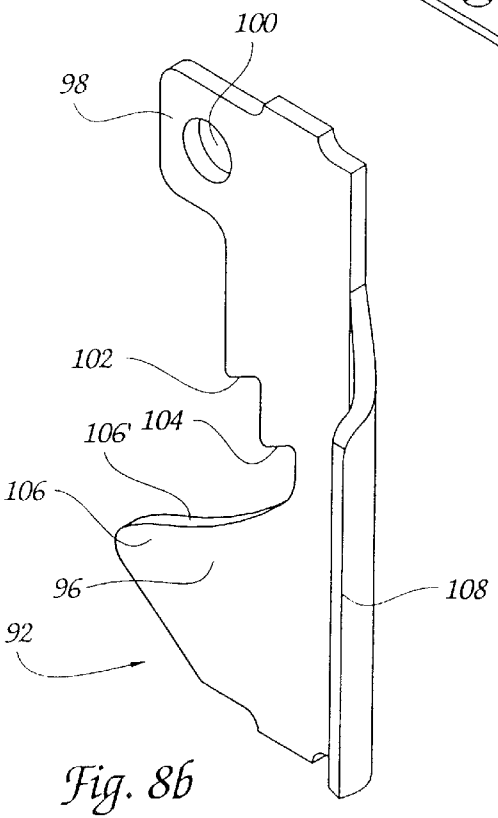
FIGS. 8A and 8B are opposing perspective views of the ratchet element of the present invention.
Figure 8A:
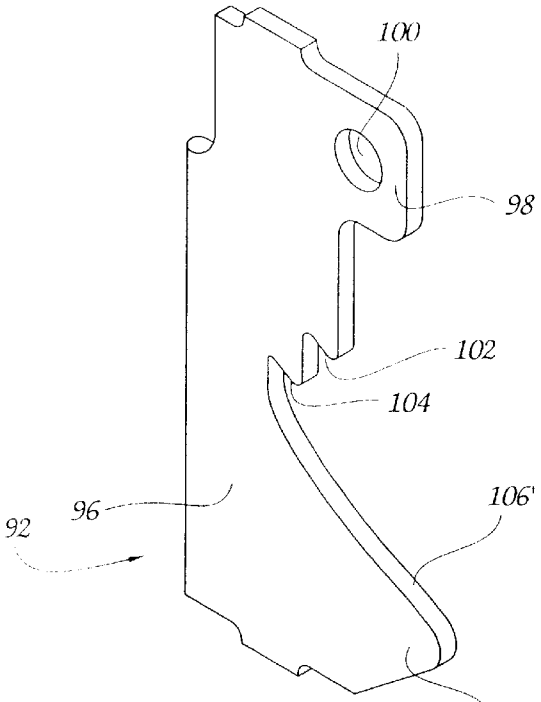

With the bed frame structure 20 thusly unfolded into its fully extended position of FIG. 3, the rear end section 32 is capable of being selectively pivoted independently into two differingly inclined "TV" positions relative to the main intermediate, second intermediate and forward end sections 34,36,38, by means of the mechanism depicted in FIGS. 4–7. As previously described, the pin-and-slot connection between the slide link 70 and the side rail 50 of the rear end section 32 permits independent pivoting movement of the rear end section 32 relative to the main intermediate section 34. A ratchet element 92 is affixed to the slide link 70 approximately midway along its length to pivot freely with respect to the slide link 70 and thereby to gravitationally extend downwardly therefrom through a recessed slot 94 formed in the forwardmost end of the side rail 50 of the rear end section 32. The ratchet element 92 is best seen in FIGS. 8A and 8B and basically is fabricated by stamping from sheet metal stock to have a planar main body 96 formed at its forwardly facing edge with a mounting tongue 98 through which a pivot opening 100 is formed, a recessed area therebelow forming two vertically spaced ratchet teeth 102, 104, and a forwardly projecting rounded nose portion 106 at its lower depending end, with a lip 108 projecting laterally from the rearward edge of the main body 96.

Figure 9:
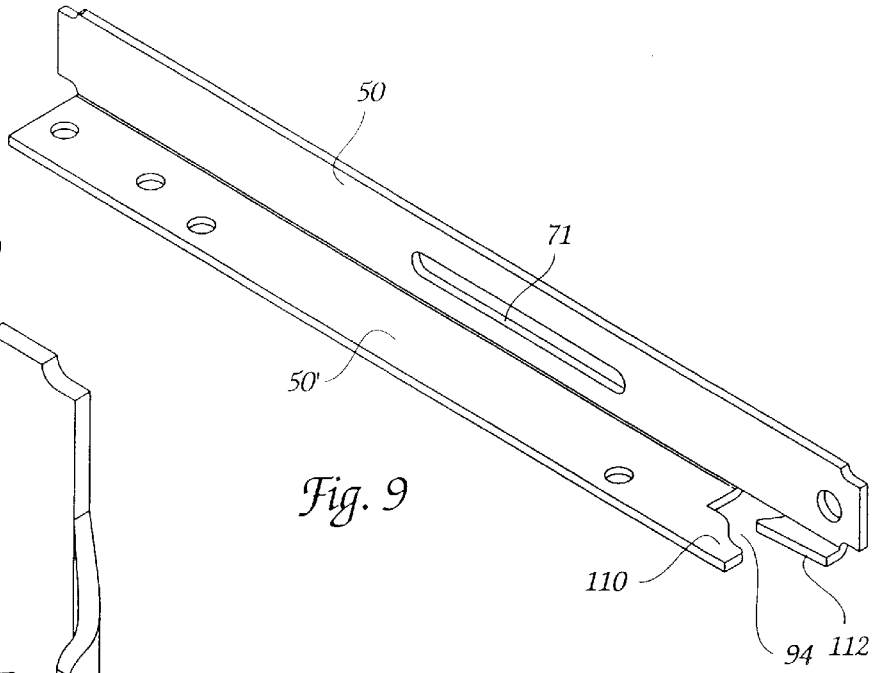
FIG. 9 is a perspective view of the side rail for the rear end section in accordance with the present invention.

The recessed slot 94 in the rear end section side rail 50 is best seen in FIG. 9. As will be understood, the horizontal ledge 50' of the side rail 50 would normally be fabricated with a perpendicularly extending forward end edge to abut with the corresponding rearward end edge of the side rail 50 of the main intermediate section 34 in the extended condition of the bed frame structure 20. To accommodate the ratchet element 92, the forward end edge of the horizontal ledge 50' is partially cut away to form a forwardly projecting flange 110 spaced outwardly from the vertical surface of the side rail 50 and terminating rearwardly from the forward end thereof and a tab 112 adjoining the vertical portion of the side rail 50 at a forward and lateral spacing from the flange 110, thereby to define the recessed slot 94 between the flange 110 and the tab 112 in a tapering configuration. The ratchet element 92 extends downwardly from the slide link 70 to be guided in pivoted movement between the flange 110 and the tab 112.

Figure 4:
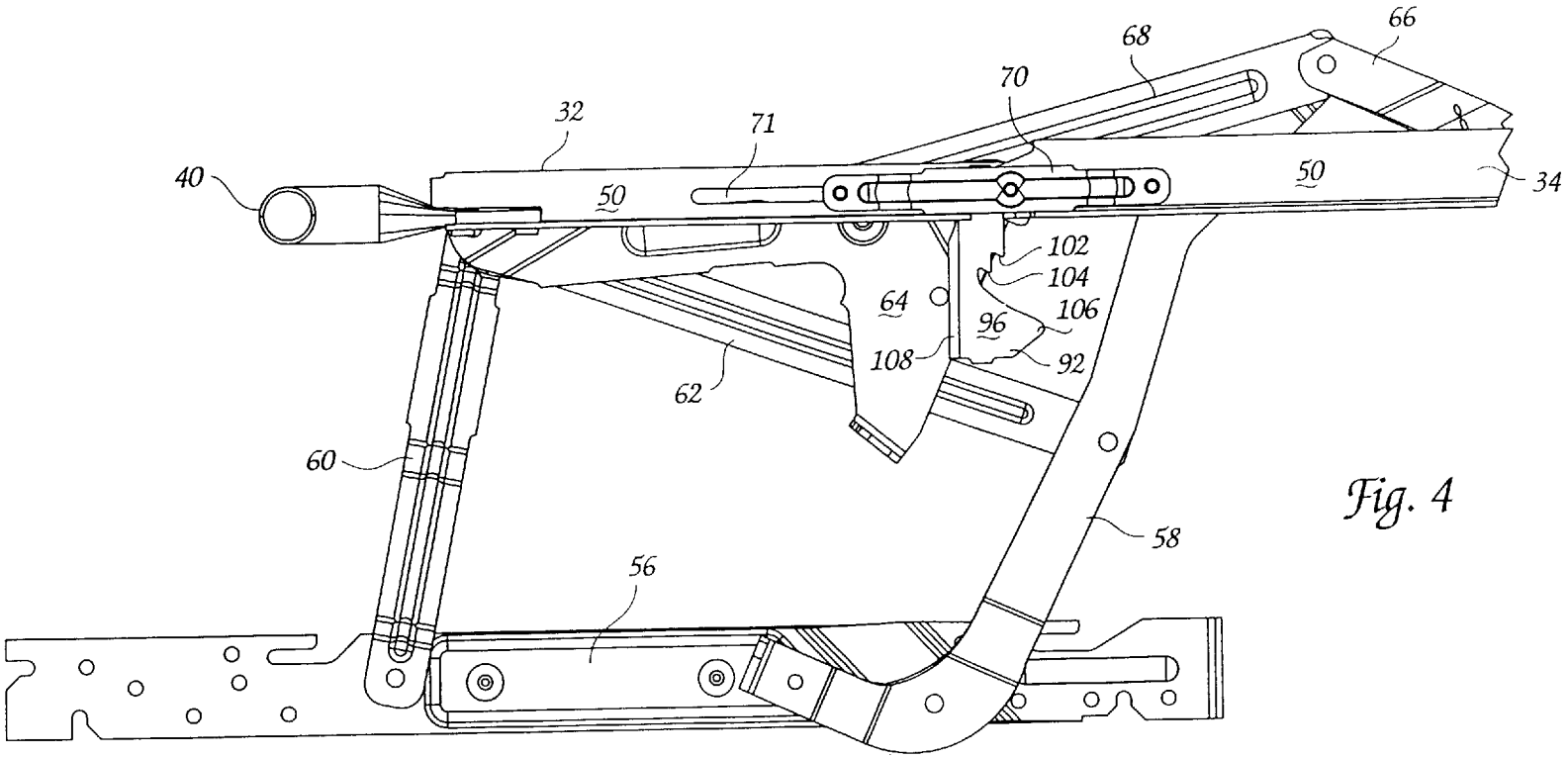
FIGS. 4–7 are more enlarged side elevational views, similar to FIGS. 1–3, showing the area of the pivotal interconnection between the rear end section and the intermediate section in successive dispositions in the pivoting movement of the rear end section between its sleeping position horizontally aligned with the intermediate section, the first and second TV positions, and the release position.

The operation of the ratchet element 92 may thus be understood with reference to the sequence of views in FIGS. 4–7. FIG. 4 depicts in side elevation the rear end section 32 and the adjacent pivoted end of the main intermediate section 34 in the fully extended condition of FIG. 3, but substantially enlarged therefrom. In this condition, the rear end and main intermediate sections 32,34 are substantially horizontally aligned end to end, with the respective vertical portions of their side rails 50 in end abutment. In this condition, the slide link 70 likewise extends horizontally in alignment with the rear end and main intermediate sections 32,34, the slide link 70 being disposed at the forwardmost end of the slot 71 in the rear end section side rail 50. The ratchet element 92 extends downwardly through the slot 94 in the rear end section side rail 50 in an inactive position.

Figure 5:
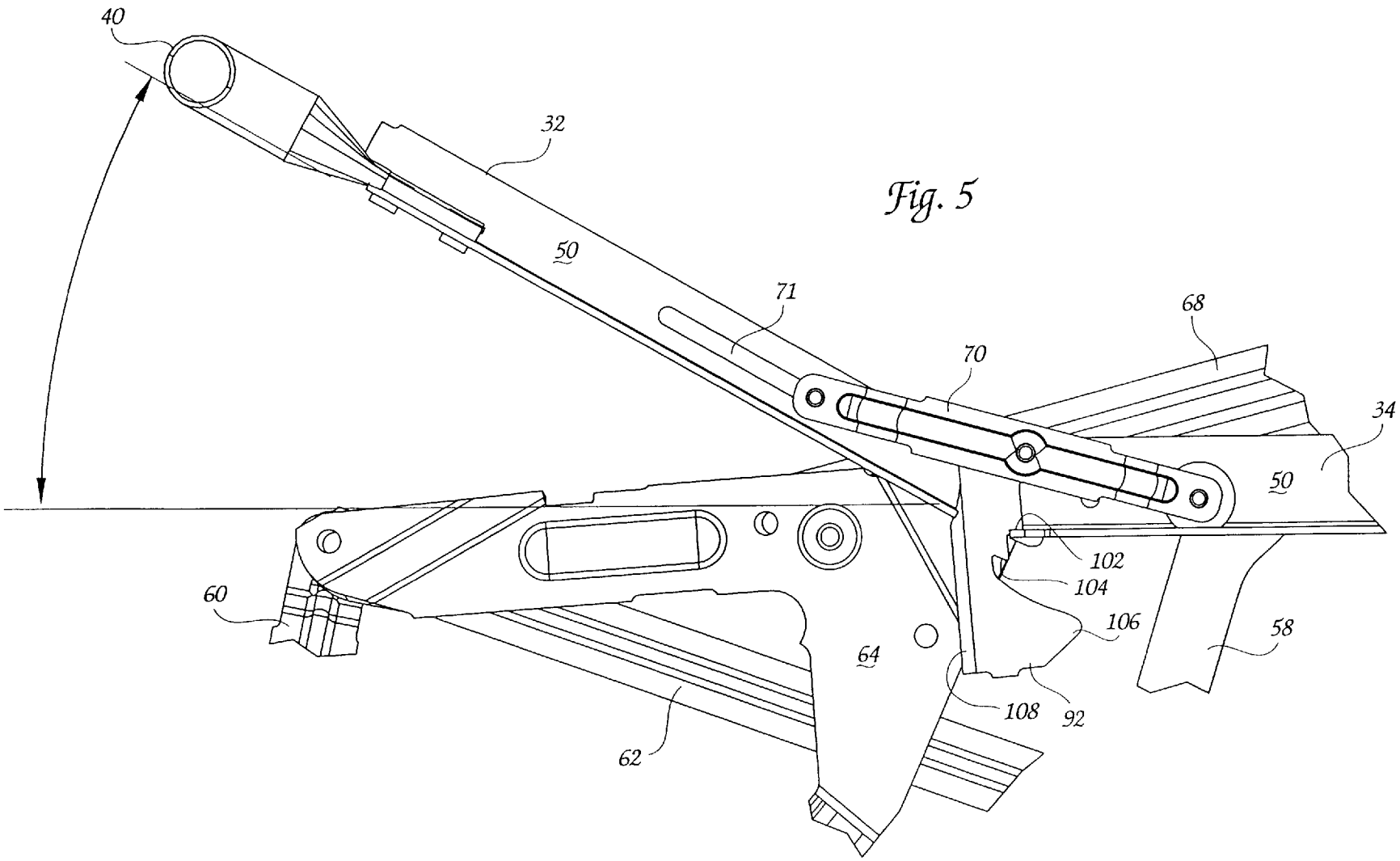
Figure 5A:
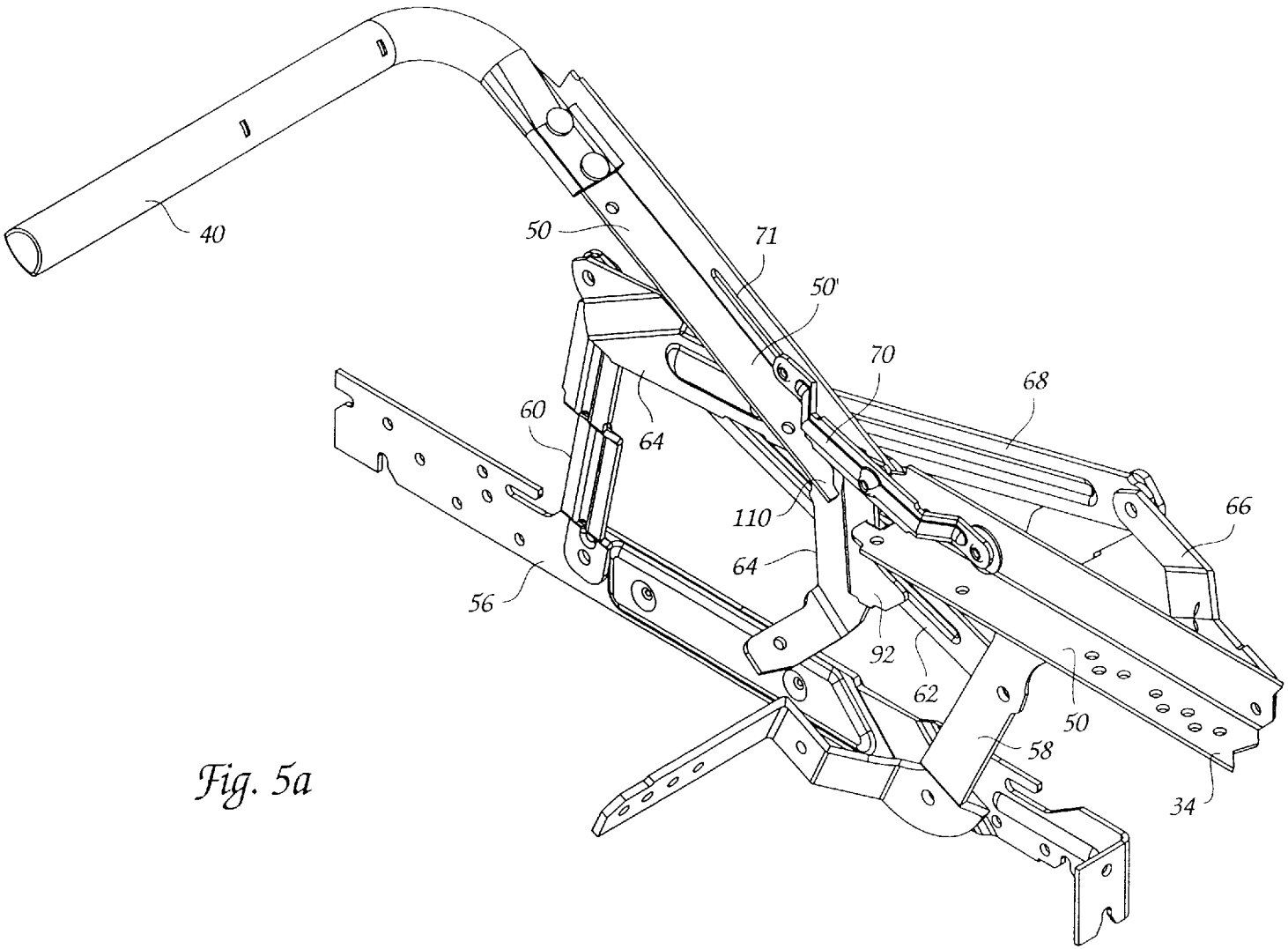
FIGS. 5A and 6A depict the rear end and intermediate sections, and the associated control linkage components, in perspective view in their dispositions corresponding respectively to the side elevational views of FIGS. 5 and 6.

The pin-and-slot connection of the slide link 70 with the rear end section side rail 50 permits the rear end section to be pivoted upwardly, e.g., by grasping and lifting its free end 40, causing the link 70 to slide rearwardly within the slot 71, as depicted in FIG. 5. As the slide link 70 is correspondingly lifted into an inclined disposition, the ratchet element 92 is raised therewith to bring the uppermost ratchet tooth 102 into resting engagement on the rearward end edge of the side rail 50 of the main intermediate section 34, wherein the ratchet element 92 thusly secures the rear end section 32 in a first "TV" position, shown in FIG. 5 and in a corresponding perspective view in FIG. 5A. As similarly shown in FIGS. 6 and 6A, further upward inclination of the rear end section 32 similarly brings the second ratchet tooth 104 into resting engagement on the rearward end edge of the main intermediate section side rail 50, to define a second less acutely inclined "TV" position. During such movements, the freely pivoted mounting of the ratchet element 92 to the slide link 70 ensures that the ratchet element 92 hangs gravitationally, whereby the weight distribution of the ratchet element 92 acts to urge the ratchet teeth 102,104 forwardly into engagement with the main intermediate section side rail 50. As will be understood, the teeth 102,104 of the ratchet element 92 may be selectively profiled so as to define the two TV positions at any desired angular inclination. In the preferred embodiment of the present invention, the first TV position of FIGS. 5 and 5A orients the rear end section 32 at an approximately twenty-nine degree (29°) angle relative to the main intermediate section 34, whereas the angular inclination of the rear end section 32 is approximately forty-two degrees (42°) in the second TV position of FIGS. 6 and 6A.

Figure 6A:
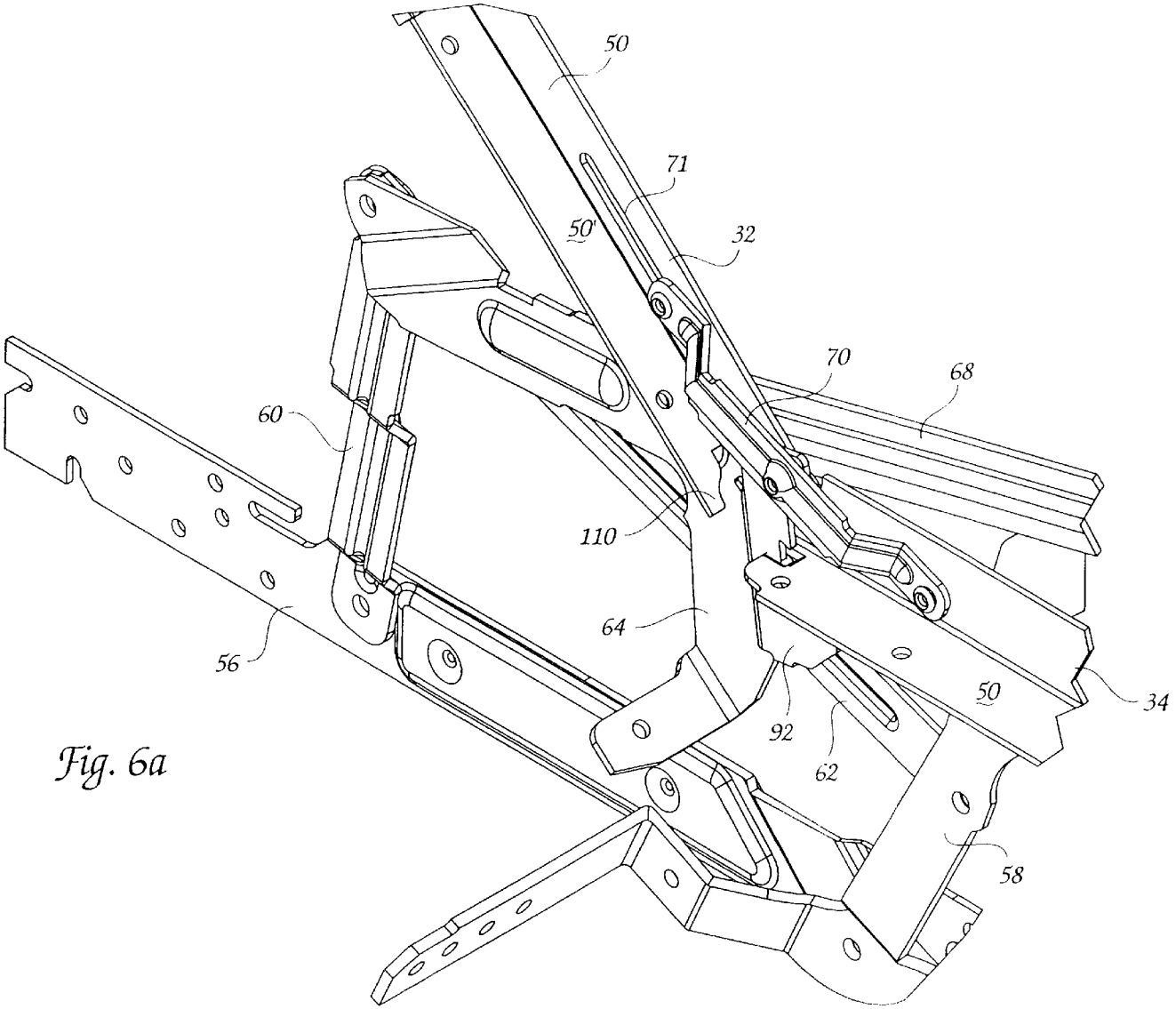

Disengagement of the ratchet element 92 from either of the two TV positions of FIGS. 5 and 6 is accomplished by further pivoting of the rear end section 32 upwardly relative to the main intermediate section 34 so as to elevate the slide link 70 and the ratchet element 92 sufficiently to bring the nose portion 106 into engagement with the rearward end edge of the main intermediate section side rail 50. The nose portion 106 is profiled in a configuration to act as a cam, the upwardly facing surface 106' being inclined to deflect the ratchet element 92 to pivot rearwardly away from the main intermediate section side rail 50 upon engagement therewith, permitting the rear end section 32 to be pivoted sufficiently to draw the ratchet element 92 with the slide link 70 fully above the elevation of the main intermediate section side rail 50, as depicted in FIG. 7. In doing so, the tapered lateral surface 94' defining the slot 94 in the horizontal ledge 50' of the rear end section side rail 50 also acts as a cam surface to deflect the ratchet element 92 slightly laterally toward the side rail 50 to dispose the lip portion 108 to engage rearwardly behind the tab 112 in the side rail 50, thereby to retain the ratchet element 92 in the rearwardly pivoted orientation effected by the cam nose portion 106. Upon subsequent pivoting movement of the rear end section 32 downwardly, the rearwardly pivoted ratchet element 92 is held out of engagement with the main intermediate section side rail 50 and thusly permits the rear end section 32 to be lowered into its original horizontal disposition aligned with the main intermediate section 34.

As will be understood, the profile of the ratchet element 92 and, particularly, its cam portion 106 can be selected to determine the angular inclination of the rear end section 32 at which such disengagement of the ratchet element 92 is accomplished. As will be understood from FIGS. 1–3, the rear end section 32 is pivoted automatically relative to the main intermediate section 34 during folding of the bed frame structure 20 from its fully extended condition of FIG. 3 back into its folded condition of FIG. 1 stored within the sofa frame 22. Hence, it is preferred that the ratchet element 92 be selectively profiled to accomplish the described disengaging operation at the same or a slightly lesser angular inclination relative to the main intermediate section 34 than the rear end section assumes in the folded condition of the bed frame structure 20. In this manner, the ratchet element 92 automatically disengages from either TV position upon folding of the bed frame structure 20 back into the sofa frame 22, without requiring the rear end section 32 to be first manually returned to its original horizontal disposition. Hence, in the preferred embodiment of the present invention illustrated in the accompanying drawings, it will be recognized that the ratchet element 92 has been selectively profiled to accomplish disengagement upon pivoting of the rear end section 32 into a substantially vertical orientation slightly beyond perpendicular relation with the main intermediate section 34 (i.e., an approximately one hundred degree (100°) angle relative thereto), as shown in FIG. 7, which is substantially the same angular orientation assumed between the rear end and main intermediate sections 32,34 in the folded condition of the bed frame structure shown in FIG. 1.

The advantages of the present bed frame structure 20 over known bed frame structures may thus be recognized. First, in substantial contrast to conventional folding sofa bed frame structures which enable selective inclination of the rear end section into a "TV" position, the ratchet arrangement of the present invention is substantially simplified and will operate more reliably over an extended life of the sofa bed frame structure. Engagement of the rear end section 32 into either TV position of FIGS. 6 or 7 is accomplished merely by lifting the rear end section 32, without requiring any manual manipulation of the latching components. Similarly, the disengagement of the present bed frame structure from either TV position in order to return the rear end section 32 to its horizontal sleeping position is easily accomplished merely by lifting the rear end section 32 to the disengagement position of FIG. 7 and then pivoting the rear end section 32 downwardly, again without requiring any manual manipulation of the latching components. In the same manner, the present invention automatically disengages the TV positions each time the bed frame structure 20 is folded back into the sofa frame 22, thereby avoiding any necessity to manually disengage the TV positions before folding the bed frame structure and, importantly, thereby avoiding the risk present in conventional structures of potentially damaging the latching components if folding is initiated without disengaging the TV positions.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A folding bed frame structure for sofa beds comprising:

(a) a plurality of bed sections pivotally connected in end-to-end relation, and (b) linkage means adapted for affixation to a sofa frame and operably associated with the bed sections for supporting the bed sections on the frame and controlling movement of the bed sections in a predetermined pattern between a rearward retracted position in which the bed sections are folded relative to one another within the frame and a forward extended position in which the bed sections are horizontally aligned, (c) wherein the bed sections include a rear end section for support of a user's head and an intermediate section pivoted to the rear end section for primary support of a user's body when in the forward extended position, and (d) wherein the linkage means includes (i) a slide link pivotally connected at opposite ends thereof to the rear end section and to the intermediate section to extend therebetween for following relative pivoting movements thereof, and (ii) a ratchet element having first and second locking notches and an unlocking cam portion, the ratchet element being connected with the slide link to move therewith between an inactive position when the rear end section and the intermediate section are horizontally aligned, a first locking position when the rear end section and the intermediate section are pivoted into an angular relationship defaming a first TV position wherein the first notch is in engagement with the intermediate section to fix the rear end section and the intermediate section in the first TV position, a second locking position when the rear end section and the intermediate section are pivoted into another angular relationship defining a second TV position wherein the second notch is in engagement with the intermediate section to fix the rear end section and the intermediate section in the second TV position, and a release position when the rear end section and the intermediate sections are pivoted into a further angular relationship wherein the cam portion is in engagement with the intermediate section for deflecting the first and second notches away therefrom to permit relative pivoting movement of the rear end section and the intermediate section into horizontal alignment with one another.

2. A folding bed, frame structure according to claim 1, wherein the slide link is pivotably connected at opposite ends respectively to the rear end section and to the intermediate section, one said end of the slide link comprising a slidable connection with the respective bed section to permit relative pivoting movements of the rear end bed section, the intermediate bed section and the slide link.

3. A folding bed frame structure according to claim 2, wherein the ratchet element is pivotably affixed to the slide link.

4. A folding bed frame structure according to claim 1, wherein the intermediate section comprises a side rail, the ratchet element being disposed to engage the side rail with the first and second notches and the cam portion.

5. A folding bed frame structure according to claim 4, wherein the rear end section comprises a side rail formed with a recessed area to receive the ratchet element.

6. A folding bed frame structure according to claim 1, wherein the rear end section is acutely angled relative to the intermediate section in the first TV position, is less acutely angled relative to the intermediate section in the second TV position, and is angled generally perpendicularly relative to the intermediate section in the release position.

7. A folding bed frame structure according to claim 6, wherein the rear end section is angled at approximately twenty-nine degrees (29°) relative to the intermediate section in the first TV position, is angled at approximately forty-two degrees (42°) relative to the intermediate section in the second TV position, and is angled at approximately one hundred degrees (100°) relative to the intermediate section in the release position.

* * * * *